US010386739B2

(12) United States Patent
Tsumura et al.

(10) Patent No.: US 10,386,739 B2
(45) Date of Patent: Aug. 20, 2019

(54) TONER PRODUCTION METHOD

(71) Applicant: ZEON CORPORATION, Tokyo (JP)

(72) Inventors: Ryo Tsumura, Tokyo (JP); Junichi Takashima, Tokyo (JP); Fuminari Oyama, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/945,145

(22) Filed: Apr. 4, 2018

(65) Prior Publication Data

US 2018/0292764 A1 Oct. 11, 2018

(30) Foreign Application Priority Data

Apr. 6, 2017 (JP) ..... 2017-076126

(51) Int. Cl.
*G03G 9/08* (2006.01)
*G03G 9/09* (2006.01)
*G03G 9/087* (2006.01)

(52) U.S. Cl.
CPC ..... *G03G 9/0806* (2013.01); *G03G 9/0812* (2013.01); *G03G 9/08728* (2013.01); *G03G 9/08793* (2013.01); *G03G 9/0918* (2013.01)

(58) Field of Classification Search
CPC ..... G03G 9/0806; G03G 9/0804
See application file for complete search history.

(56) References Cited

U.S. PATENT DOCUMENTS

2006/0172221 A1* 8/2006 Kurokawa ..... G03G 9/0806 430/137.15

FOREIGN PATENT DOCUMENTS

JP 2011-70048 A 4/2011

* cited by examiner

*Primary Examiner* — Peter L Vajda
(74) *Attorney, Agent, or Firm* — Westerman, Hattori, Daniels & Adrian, LLP

(57) ABSTRACT

The present invention is to provide a toner production method configured to prevent scale formation, be resistant to pipe clogging, and realize stable and efficient toner production, even in the case of long-term continuous production. Disclosed is a toner production method comprising: a dispersing step for obtaining a colorant dispersion by, in a stirring tank, (a) dispersing or dissolving a colorant and a charge control agent in a polymerizable monomer, or (b) dispersing or dissolving a binder resin, a colorant and a charge control agent in an organic solvent, and a droplets forming step by suspending the colorant dispersion in an aqueous dispersion medium, wherein, in the dispersing step, the binder resin, colorant or charge control agent is added to the polymerizable monomer or organic solvent in the stirring tank, from a hopper, through a pipe heated by a heating device.

3 Claims, 1 Drawing Sheet

TONER PRODUCTION METHOD

TECHNICAL FIELD

The present invention relates to a toner production method used for printing by an electrophotography or electrostatic recording method.

BACKGROUND

Wet methods such as polymerization methods (e.g., a suspension polymerization method, an emulsion polymerization aggregation method, a dispersion polymerization method) and a solution suspension method have been used to produce a toner containing colored resin particles that contain a binder resin and a colorant, since it is easy to control the form, particle diameter and particle distribution of the particles.

However, in the toner production by these methods, there is the following problem: since the toner production includes many steps of adding powdery raw materials (e.g., a colorant and a charge control agent) to liquid raw materials (e.g., a polymerizable monomer and an organic solvent), these powdery raw materials are wet and deposits (hereinafter may be referred to as "scale") are likely to attach to and accumulate on the inner wall of a pipe or container, resulting in a decrease in yield, a decrease in image quality (since the deposits are detached as coarse particles and mixed into a toner thus obtained) and pipe clogging during continuous production in batches; therefore, the pipe needs to be detached and cleaned.

To solve the problem, various studies have been made from the viewpoint of preventing scale formation, preventing scale attachment to a pipe, etc.

For example, Patent Literature 1 discloses a toner production method in which, in the polymerization step of the toner production by a suspension polymerization method, a carrier gas at a temperature in a given range, is introduced into a gas phase part in a polymerization container containing a polymerizable monomer, thereby preventing the formation and attachment of polymer deposits to the inner wall of the polymerization container.

Patent Literature 1: Japanese Patent Application Laid-Open (JP-A) No. 2011-70048

However, in the method of Patent Literature 1, when the temperature of the polymerization container is high, the polymerizable monomer is vaporized to produce large amounts of vapor, and the amount of vapor that enters a powdery raw material injection pipe, increases to wet the powdery raw materials; therefore, pipe clogging may occur. As just described, the technique to stably and efficiently produce a toner with preventing scale formation, scale attachment to a pipe, etc., is still insufficient and requires further improvement.

SUMMARY

An object of the present invention is to provide a toner production method configured to prevent scale formation, be resistant to pipe clogging, and realize stable and efficient toner production, even in the case of long-term continuous production.

The inventors of the present invention made considerable studies on operations and apparatuses (e.g., a pipe) relating to the step of adding a powdery raw material to a liquid raw material in the toner production. As a result of the considerable studies, they thought that a main cause for pipe clogging is the following process: vapor of the liquid raw material flows up a pipe when the powdery raw material is injected into the pipe; the vapor is cooled down in a low-temperature pipe and condensed into small droplets; once the powdery raw material attaches to the droplets, it serves as a core, and scale is gradually grown. The inventors of the present invention found that this problem can be solved by suppressing the condensation by heating the pipe. Based on these findings, the present invention was achieved.

According to the present invention,

[1] there is provided a toner production method comprising:

a dispersing step for obtaining a colorant dispersion by, in a stirring tank, (a) dispersing or dissolving a colorant and a charge control agent in a polymerizable monomer, or (b) dispersing or dissolving a binder resin, a colorant and a charge control agent in an organic solvent, and a droplets forming step by suspending the colorant dispersion in an aqueous dispersion medium, wherein, in the dispersing step, the binder resin, colorant or charge control agent is added to the polymerizable monomer or organic solvent in the stirring tank, from a hopper disposed in an upper part of the stirring tank, through a pipe heated by a heating device;

[2] there is also provided the toner production method according to the above [1], wherein, in the dispersing step, a release agent and/or a retention aid is further added to the polymerizable monomer or organic solvent in the stirring tank, from the hopper disposed in the upper part of the stirring tank, through the pipe heated by the heating device;

[3] there is also provided the toner production method according to the above [1] or [2], wherein a heating temperature of the pipe is higher than a condensation temperature at which the polymerizable monomer or organic solvent is vaporized; and

[4] there is also provided the toner production method according to any one of the above [1] to [3], wherein the heating device is a self-temperature-regulating electric heater that is able to control power output depending on temperature change.

According to the present invention, even in the case of long-term continuous production, a toner can be stably and efficiently produced, with preventing scale formation and suppressing pipe clogging.

BRIEF DESCRIPTION OF THE DRAWINGS

In the accompanying drawings.

DETAILED DESCRIPTION

Figure 1:
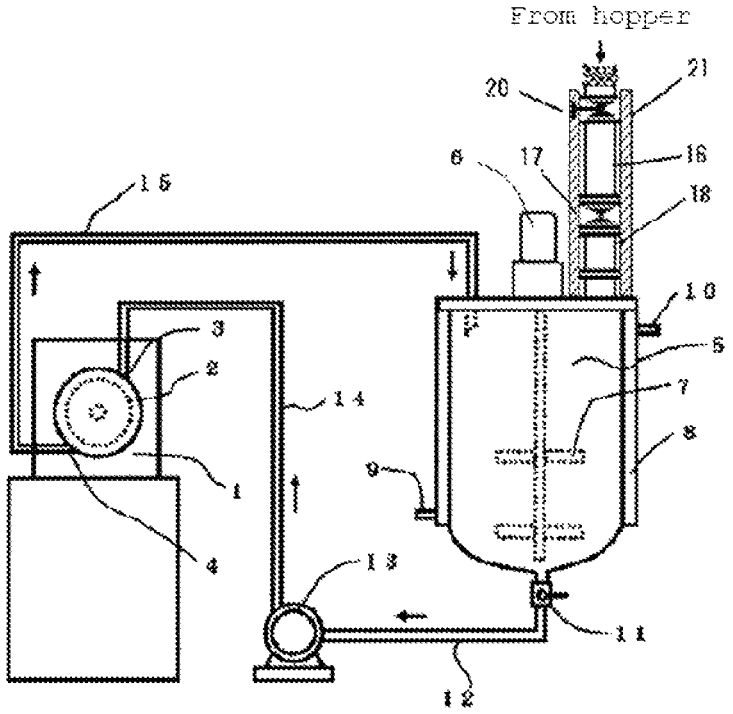
FIG. 1 is a schematic view of an example of a device used to prepare a colorant dispersion (a polymerizable monomer composition) used in the present invention.

The toner production method of the present invention is a toner production method comprising: a dispersing step for obtaining a colorant dispersion by, in a stirring tank, (a) dispersing or dissolving a colorant and a charge control agent in a polymerizable monomer, or (b) dispersing or dissolving a binder resin, a colorant and a charge control agent in an organic solvent, and a droplets forming step by suspending the colorant dispersion in an aqueous dispersion medium, wherein, in the dispersing step, the binder resin, colorant or charge control agent is added to the polymerizable monomer or organic solvent in the stirring tank, from a hopper disposed in an upper part of the stirring tank, through a pipe heated by a heating device.

Hereinafter, the toner production method of the present invention will be described with reference to an example of the device that is used in the present invention and shown in FIG. 1.

(1) Dispersing Step for Obtaining Colorant Dispersion

The colorant dispersion is prepared by (a) dispersing or dissolving a colorant and a charge control agent in a polymerizable monomer, or (b) dispersing or dissolving a binder resin, a colorant and a charge control agent in an organic solvent. From the viewpoint of efficiently obtaining the colorant dispersion in which the colorant is uniformly dispersed, the colorant dispersion is preferably obtained by preparing a preliminarily prepared mixed solution in which the charge control agent is not contained, and then adding the charge control agent to the preliminarily prepared mixed solution.

(1-1) Preparation of Preliminarily Prepared Mixed Solution

A stirring tank 5 is used for the preparation, which is equipped with stirring blades 7 that are connected to a stirring motor 6. The polymerizable monomer is put in the stirring tank, and then the colorant is injected into the stirring tank. Or, the organic solvent is put in the stirring tank, and then the binder resin and the colorant are injected into the stirring tank. They are stirred and mixed to obtain a mixture. The mixture is supplied from the bottom of the stirring tank 5 to a disperser 1 by a circulation line 14, using a circulation pump 13, through a valve 11 and a circulation line 12. Then, the colorant is dispersed in and mixed with the mixture. In FIG. 1, a media type disperser is shown as the disperser 1. The mixture is supplied to the disperser 1 from a mixed solution inlet 3 of a casing 2. Then, the mixture is returned from a mixed solution outlet 4 to the stirring tank 5, in which stirring is continued by the stirring blades 7, through a return line 15. Therefore, the preliminarily prepared mixed solution is obtained. The injection of the colorant into the polymerizable monomer or the injection of the binder resin or colorant into the organic solvent, is carried out from a hopper (not shown) disposed in the upper part of the stirring tank 5, through pipes (a fill pipe 16 and an injection pipe 18) heated by a pipe heating apparatus 21 as the heating device. The pipes may be covered with a thermal insulation material that is generally used to keep pipes warm. The stirring tank 5 is preferably equipped with a jacket 8 so that a constant temperature can be kept in the tank. The jacket 8 can control the temperature by passing a medium through a temperature-regulating medium inlet 9 and circulating the medium from a temperature-regulating medium outlet 10.

In the present invention, "pipe" means a conduit communicating a hopper to a stirring tank to supply materials for producing a toner into a stirring tank. A pipe of the embodiment shown in FIG. 1 comprises a fill pipe 16 and an injection pipe 18.

Figure 2:
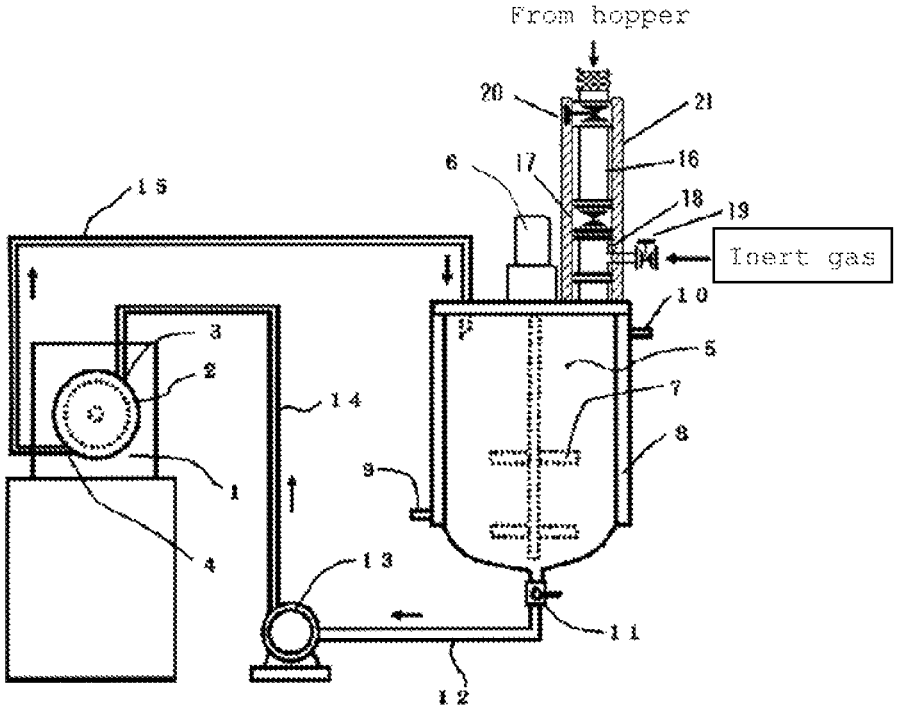
FIG. 2 is a schematic view of a different example of the device used to prepare the colorant dispersion (the polymerizable monomer composition) used in the present invention.

An inert gas introduction valve 19 as shown in FIG. 2 may be connected to the injection pipe 18, and the inside of the injection pipe may be purged by introducing an inert gas into the injection pipe 18 from the inert gas introduction valve 19, before and after the injection of the colorant into the polymerizable monomer or the injection of the binder resin or colorant into the organic solvent. As the inert gas used for the purging, examples include, but are not limited to, rare gas (e.g., helium and argon), dry air and nitrogen. The purging is preferably carried out two to three times, for about 30 seconds each time. The inner surface of the fill pipe 16 may be coated with fluorine resin. As the fluorine resin, for example, polytetrafluoroethylene resin (PFA) is preferably used. These measures can contribute to the prevention of scale formation and the suppression of pipe clogging.

<Polymerizable Monomer>

In the present invention, the polymerizable monomer means a polymerizable compound.

As a main component of the polymerizable monomer, a monovinyl monomer is preferably used. As the monovinyl monomer, examples include, but are not limited to, styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; derivatives of acrylic acid and methacrylic acid, such as acrylonitrile, methacrylonitrile, acrylamide and methacrylamide; olefins such as ethylene, propylene and butylene; vinyl halides and vinylidene halide, such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used alone or in combination of two or more kinds. Among them, styrene, styrene derivatives, acrylic esters and methacrylic esters are preferably used as the monovinyl monomer.

To improve the hot offset of the toner to be obtained, it is preferable to use a crosslinkable polymerizable monomer together with the monovinyl monomer. The crosslinkable polymerizable monomer means a polymerizable monomer having two or more polymerizable functional groups. As the crosslinkable polymerizable monomer, examples include, but are not limited to, aromatic divinyl compounds such as divinyl benzene, divinyl naphthalene and derivatives thereof; diacrylate compounds such as ethylene glycol dimethacrylate and diethylene glycol dimethacrylate; other divinyl compounds such as N,N-divinylaniline and divinyl ether; and compounds having three or more vinyl groups. Of them, divinylbenzene is preferred from the viewpoint of availability. These crosslinkable polymerizable monomers can be used alone or in combination of two or more kinds.

In the present invention, the amount of the crosslinkable polymerizable monomer is generally from 0.1 part by mass to 5 parts by mass, and preferably from 0.3 part by mass to 2 parts by mass, with respect to 100 parts by mass of the monovinyl monomer.

Also, it is preferable to use a macromonomer as a part of the polymerizable monomer, since the balance between the storage stability and low-temperature fixability of the toner to be obtained can be improved. The macromonomer is a reactive oligomer or polymer having a polymerizable carbon-carbon unsaturated double bond at the end of a polymer chain and generally having a number average molecular mass of from 1,000 to 30,000.

The macromonomer is preferably one that can provide a polymer having a higher glass transition temperature (Tg) than a polymer obtained by polymerization of a monovinyl monomer. The amount of the macromonomer is generally 0.01 part by mass to 10 parts by mass, preferably from 0.03 part by mass to 5 parts by mass, and more preferably from 0.05 part by mass to 1 part by mass, with respect to 100 parts by mass of the monovinyl monomer.

<Binder Resin>

The binder resin used in the present invention is not particularly limited and can be appropriately selected from known binder resins. As the binder resin, examples include, but are not limited to, polystyrene resin, polyester resin, styrene-alkyl acrylate copolymer, styrene-alkyl methacrylate copolymer, styrene-acrylonitrile copolymer, styrene-butadiene copolymer, styrene-maleic anhydride copolymer, polyethylene resin, and polypropylene resin. These binder resins can be used alone or in combination of two or more kinds.

<Organic Solvent>

The organic solvent used in the present invention is not particularly limited. From the viewpoint of ease of solvent removal, the organic solvent is preferably a volatile organic solvent having a boiling point of less than 100° C. As the organic solvent, examples include, but are not limited to, toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, and methyl isobutyl ketone. These organic solvents can be used alone or in combination of two or more kinds.

<Colorant>

In the present invention, the colorant is used. In the case of producing color toners (generally, four kinds of toners are used, which are black, cyan, yellow and magenta toners), black, cyan, yellow and magenta colorants can be used.

As the black colorant, for example, carbon black, titanium black, and pigments such as magnetic powders of zinc iron oxide and nickel iron oxide, can be used in the present invention.

As the cyan colorant, for example, copper phthalocyanine compounds and derivatives thereof, and anthraquinone compounds can be used. In particular, examples include, but are not limited to, C.I. Pigment Blue 2, 3, 6, 15, 15:1, 15:2, 15:3, 15:4, 16, 17:1 and 60. Preferred are copper phthalocyanine compounds such as C.I. Pigment Blue 15, 15:1, 15:2, 15:3, 15:4 and 17:1, since they are stable in polymerization and have coloring power. Of them, C.I. Pigment Blue 15:3 is more preferred.

As the yellow colorant, for example, azo pigments such as a monoazo pigment and a disazo pigment, and compounds such as a condensed polycyclic pigment, can be used. In particular, examples include, but are not limited to, C.I. Pigment Yellow 3, 12, 13, 14, 15, 17, 62, 65, 73, 74, 83, 93, 97, 120, 138, 155, 180, 181, 185 and 186.

As the magenta colorant, for example, azo pigments such as a monoazo pigment and a disazo pigment, and compounds such as a condensed polycyclic pigment, can be used. In particular, examples include, but are not limited to, C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19. Preferred are monoazo pigments such as C.I. Pigment Red 31, 48, 57:1, 58, 60, 63, 64, 68, 112, 114, 146, 150, 163, 170, 185, 187, 206 and 207, since they are stable in polymerization and have coloring power.

The amount of the colorant is preferably from 1 part by mass to 10 parts by mass, with respect to 100 parts by mass of the binder resin component contained in the toner.

<Disperser>

As the disperser 1 used in the present invention, examples include, but are not limited to, a media type disperser, an in-line type emulsifying disperser, and a high-speed emulsifying disperser. Of them, preferred is a media type disperser. As shown in FIG. 1, the media type disperser generally comprises the casing 2 and a stirring body (not shown). The casing 2 has an inlet for supplying a mixed solution such as the above-mentioned mixture (a mixed solution inlet 3) and an outlet (a mixed solution outlet 4). The stirring body is rotatably disposed inside a stator. A space between the casing 2 and the stirring body is filled with a medium, and the medium is moved by the stirring body when the stirring body is rotated.

There are many types of media type dispersers that are vary in the shape and configuration of the casing (e.g., a horizontal cylindrical media type disperser, a vertical cylindrical media type disperser, and an inverted triangular media type disperser). As the media type disperser, a horizontal cylindrical disperser is preferred, since it can suppress viscosity change and achieve excellent dispersion. As the horizontal cylindrical media type disperser, a disperser comprising a media separation screen is preferred. Particularly preferred is a disperser in which the media separation screen rotates simultaneously with the rotor of the stirring body disposed inside the casing. The disperser is particularly preferably Pico Grain Mill (product name, manufactured by Asada Iron Works Co., Ltd.)

<Heating Device>

The heating device used in the present invention is an apparatus that is able to heat the pipes used to add the colorant and so on to the polymerizable monomer or organic solvent. By the heating device, the pipes are heated to suppress the condensation of vapor of the polymerizable monomer or organic solvent in the pipes at low temperature. Therefore, scale formation and pipe clogging are considered to be suppressed, both of which are caused by the attachment of the colorant and so on to the droplets produced by the condensation. The heating device is not particularly limited. As the heating device, examples include, but are not limited to, a heater comprising an elongated heating part, a hot air generator such as a dryer, a jacket used by passing a heating medium therethrough, and a self-temperature-regulating electric heater.

Of them, the self-temperature-regulating electric heater is preferred, since it provides high temperature uniformity over time. The self-temperature-regulating electric heater has a basic structure in which an electroconductive polymer resistor is sandwiched between two parallel conductors. Moreover, it forms a continuous heating circuit between parallel conductors in the electroconductive polymer resistor. The parallel conductors and the electroconductive polymer resistor are covered with an insulating cover. When the element of the electroconductive polymer resistor is heated, the core slightly expands, thereby increasing the electrical resistance of the core and decreasing the power output of the heater. When the temperature of the core decreases, it slightly contracts, thereby decreasing the electrical resistance of the core and increasing the power output of the heater. In this manner, the self-temperature-regulating electric heater is able to control power output depending on temperature change, and it can keep a constant temperature. As the self-temperature-regulating electric heater, examples include, but are not limited to, commercial products such as a self-regulating heating cable manufactured by Pentair Technical Solutions. Since the self-temperature-regulating electric heater is generally in a cable form, before use, it is wound around the pipes to be heated.

The position where the heating device is attached to the pipe to be heated, the pipe being connected to the stirring tank, is not particularly limited. From the viewpoint of efficiently and sufficiently suppressing the condensation of the vapor of the polymerizable monomer or organic solvent in the pipe, the heating device is preferably attached from the connecting position of the stirring tank and the pipe to the position reached by the vapor flowing in the pipe.

For example, in the embodiment shown in FIG. 1, as the heating device, the pipe heating apparatus 21 is attached from the connecting position of the stirring tank and the injection pipe to a material switching valve 20. As shown in FIG. 1, the pipes used for the addition of the colorant and so on, are generally connected through a valve. Therefore, for inspection and exchange of the valve and pipes, the heating device is preferably attached to the pipes so that the valve and pipes can be easily removed and attached. For example, in the case of using the self-temperature-regulating electric heater as the pipe heating apparatus 21, it is preferable that one or more electric heaters are attached to heat the material switching valve 20 and the fill pipe 16, while one or more electric heaters are separately attached to heat an injection valve 17 and the injection pipe 18.

From the viewpoint of sufficiently suppressing the condensation of the vapor of the polymerizable monomer or organic solvent used, the heating temperature of the pipes is preferably higher than the condensation temperature at which the polymerizable monomer or organic solvent is vaporized. The heating temperature is generally from 45° C. to 60° C., preferably from 50° C. to 60° C., and more preferably from 50° C. to 55° C.

(1-2) Preparation of Colorant Dispersion

As needed, a release agent and/or retention aid is injected into the preliminarily prepared mixed solution obtained in the above "(1-1) Preparation of preliminarily prepared mixed solution", the mixed solution being stirred in the stirring tank 5 by the stirring blades 7 that are connected to the stirring motor 6. Then, a charge control agent (hereinafter may be referred to as "CCA") is injected thereinto, and they are stirred and mixed in the stirring tank 5, thereby obtaining a colorant dispersion. The optional injection of the release agent and/or retention aid into the preliminarily prepared mixed solution, or the injection of the CCA into the preliminarily prepared mixed solution, is carried out from the hopper (not shown) disposed in the upper part of the stirring tank 5, through the pipes (the fill pipe 16 and the injection pipe 18) heated by the pipe heating apparatus 21 as the heating device.

As with the above "(1-1) Preparation of preliminarily prepared mixed solution", the inside of the injection pipe 18 may be purged by introducing the inert gas into the injection pipe from the inert gas introduction valve 19, before and after the addition of the CCA and so on to the preliminarily prepared mixed solution.

<Charge Control Agent>

The charge control agent used in the present invention is not particularly limited, as long as it is one that is generally used as a charge control agent for toners. Among charge control agents, a positively or negatively chargeable charge control resin is preferred, since the charge control resin can impart stable chargeability (charge stability) to toner.

As the positively chargeable charge control agent, examples include, but are not limited to, a nigrosine dye, a quaternary ammonium salt, a triaminotriphenylmethane compound, an imidazole compound, a polyamine resin, a quaternary ammonium group-containing copolymer, and a quaternary ammonium salt group-containing copolymer, which are preferably used as the charge control resin.

As the negatively chargeable charge control agent, examples include, but are not limited to, an azo dye containing a metal such as Cr, Co, Al and Fe; a metal salicylate compound; a metal alkylsalicylate compound; and a sulfonic acid group-containing copolymer, a sulfonic acid salt group-containing copolymer, a carboxylic acid group-containing copolymer and a carboxylic acid salt group-containing copolymer, which are preferably used as the charge control resin.

The amount of the charge control agent is generally from 0.01 part by mass to 10 parts by mass, and preferably from 0.03 part by mass to 8 parts by mass, with respect to 100 parts by mass of the binder resin component contained in the toner.

<Release Agent>

The release agent is not particularly limited, as long as it is one that is generally used as a release agent for toners. As the release agent, examples include, but are not limited to, low-molecular-weight polyolefin waxes such as low-molecular-weight polyethylene, low-molecular-weight polypropylene, and low-molecular-weight polybutylene; terminal-modified polyolefin waxes such as molecular-terminal-oxidized, low-molecular-weight polypropylene, low-molecular-weight, terminal-modified polypropylene having a molecular terminal substituted with an epoxy group, block polymers from a low-molecular-weight polyethylene and them, molecular-terminal-oxidized, low-molecular-weight polyethylene, low-molecular-weight polyethylene having a molecular terminal substituted with an epoxy group, and block polymers from a low-molecular-weight polypropylene and them; natural plant waxes such as candelilla, carnauba, rice, Japan wax and jojoba; petroleum waxes and modified waxes thereof, such as paraffin, microcrystalline and petrolatum; mineral waxes such as montan, ceresin and ozokerite; synthetic waxes such as Fischer-Tropsch wax; and ester waxes of polyhydric alcohol esters including pentaerythritol esters such as pentaerythritol tetramyristate, pentaerythritol tetrapalmitate, pentaerythritol tetrastearate, and pentaerythritol tetralaurate, and dipentaerythritol esters such as dipentaerythritol hexamyristate, dipentaerythritol hexapalmitate, and dipentaerythritol hexalaurate. These release agents may be used alone or in combination of two or more kinds.

Of the above release agents, from the viewpoint of balance between the fixability and releasability of the toner to be obtained, preferred are ester waxes of polyhydric alcohol esters including such a pentaerythritol ester, that the endothermic peak temperature measured by a differential scanning calorimeter from a DSC curve upon temperature increase, is in a range of from 30° C. to 150° C., preferably in a range of from 50° C. to 120° C., and more preferably in a range of from 60° C. to 100° C., and such a dipentaerythritol ester, that the endothermic peak temperature is in a range of from 50° C. to 80° C.

The amount of the release agent is preferably from 0.1 part by mass to 30 parts by mass, and more preferably from 1 part by mass to 20 parts by mass, with respect to 100 parts by mass of the binder resin component container in the toner.

<Retention Aid>

The retention aid is not particularly limited, as long as it is one that is generally used as a retention aid for toners. Since the toner can obtain an excellent balance between heat-resistant storage stability and low-temperature fixability, as well as excellent printing durability under a wide range of temperature and humidity environments, preferred is a copolymer of at least one of acrylic acid ester and methacrylic acid ester and at least one of acrylic acid and methacrylic acid (an acrylate-based copolymer). A preferable acid monomer is acrylic acid.

As the acrylate-based copolymer, examples include, but are not limited to, a copolymer of acrylic acid ester and acrylic acid, a copolymer of acrylic acid ester and methacrylic acid, a copolymer of methacrylic acid ester and acrylic acid, a copolymer of methacrylic acid ester and methacrylic acid, a copolymer of acrylic acid ester, methacrylic acid ester and acrylic acid, a copolymer of acrylic acid ester, methacrylic acid ester and methacrylic acid, and a copolymer of acrylic acid ester, methacrylic acid ester, acrylic acid and methacrylic acid. Of them, the copolymer of acrylic acid ester, methacrylic acid ester and acrylic acid is preferred.

The acid value of the copolymer is generally from 0.5 mgKOH/g to 7 mgKOH/g, preferably from 1 mgKOH/g to 6 mgKOH/g, and more preferably from 1.5 mgKOH/g to 4 mgKOH/g.

The weight average molecular weight (Mw) of the copolymer is generally from 6,000 to 50,000, preferably from 7,000 to 45,000, and more preferably from 9,000 to 40,000.

The amount of the retention aid is preferably from 0.01 part by mass to 10 parts by mass, and more preferably from 0.1 part by mass to 5 parts by mass, with respect of 100 parts by mass of the binder resin component container in the toner.

(2) Droplets Forming Step

The colorant dispersion obtained in the above "(1) Dispersing step for obtaining colorant dispersion" is added to an aqueous dispersion medium separately prepared. Using a high-speed stirring device or the like, the mixture is suspended to form droplets of the colorant dispersion, thereby obtaining an aqueous dispersion of the droplets.

In the case of the colorant dispersion prepared by the above (a), the separately prepared aqueous dispersion medium is put in a polymerization container equipped with a stirring device, for example; the colorant dispersion and, generally, a molecular weight modifier and a polymerization initiator are added thereto; and they are stirred and mixed. Meanwhile, in the case of the colorant dispersion prepared by the above (b), the separately prepared aqueous dispersion medium is put in a desired container; the colorant dispersion is added thereto; and they are stirred and mixed. In both cases, a mixture thus obtained is transferred to a high-speed stirring device and suspended, thereby forming the droplets of the colorant dispersion.

<Molecular Weight Modifier>

As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol. The molecular weight modifier can be added before or in the process of polymerization. The amount of the molecular weight modifier is preferably from 0.01 part by mass to 10 parts by mass, and more preferably from 0.1 part by mass to 5 parts by mass, with respect to 100 parts by mass of the monovinyl monomer.

<Polymerization Initiator>

In the present invention, the polymerization initiator is used to polymerize the polymerizable monomer. As the polymerization initiator, examples include, but are not limited to, persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and peroxides such as di-t-butylperoxide, benzoylperoxide, t-butylperoxy-2-ethylhexanoate, t-hexylperoxy-2-ethylhexanoate, t-butyl peroxypivalate, diisopropylperoxydicarbonate, di-t-butylperoxyisophthalate and t-butylperoxyisobutyrate. Also, a redox initiator may be used, which is a combination of the polymerization initiator and a reducing agent. Of them, peroxides are preferred since they can reduce polymerizable monomer residues, and the toner to be obtained is excellent in printing durability.

As described above, the polymerization initiator may be added when the colorant dispersion is added to the aqueous dispersion medium. Or, the polymerization initiator may be added to the colorant dispersion in advance.

The amount of the polymerization initiator added is preferably from 0.1 part by mass to 20 parts by mass, more preferably from 0.3 part by mass to 15 parts by mass, and still more preferably from 1.0 part by mass to 10 parts by mass, with respect to 100 parts by mass of the monovinyl monomer.

<Aqueous Dispersion Medium>

The aqueous dispersion medium is a dispersion stabilizer dissolved or dispersed in an aqueous medium.

In the present invention, the aqueous medium may be simply water, or it may be a combination of water and a water-soluble solvent. As the water-soluble solvent, examples include, but are not limited to, lower alcohols such as methanol, ethanol and isopropanol, and lower ketones such as dimethylformamide, tetrahydrofuran, acetone and methyl ethyl ketone.

As the dispersion stabilizer, examples include, but are not limited to, acid-soluble or alkali-soluble inorganic compounds including metal compounds such as sulfates (e.g., barium sulfate and calcium sulfate), carbonates (e.g., barium carbonate, calcium carbonate and magnesium carbonate), phosphates (e.g., calcium phosphate), metal oxides (e.g., aluminum oxide and titanium oxide), and metal hydroxides (e.g., aluminum hydroxide, magnesium hydroxide and iron (II) hydroxide). Also, the dispersion stabilizer may be used in combination with an organic polymer compound such as a water-soluble polymer (e.g., polyvinyl alcohol, methyl cellulose and gelatin), an anionic surfactant, a nonionic surfactant, and an ampholytic surfactant. These dispersion stabilizers can be used alone or in combination of two or more kinds.

Among the above dispersion stabilizers, preferred is a dispersion stabilizer containing a metal compound colloid, particularly a dispersion stabilizer containing a hardly water-soluble metal hydroxide colloid. The reason is as follows: by using such a dispersion stabilizer, the particles formed by the suspension can obtain a small particle size distribution, and the amount of the dispersion stabilizer remaining after washing can be small; therefore, the toner thus obtained can clearly reproduce an image and is excellent in environmental stability.

The amount of the dispersion stabilizer is generally from 0.1 part by mass to 20 parts by mass, and preferably from 0.2 part by mass to 10 parts by mass, with respect to 100 parts by mass of the aqueous medium.

<High-Speed Stirring Device>

The high-speed stirring device is not particularly limited. As the high-speed stirring device, a device with strong stirring ability can be used. As the device, examples include, but are not limited to, in-line type emulsifying dispersers such as Milder MDN303V (product name, manufactured by Pacific Machinery & Engineering Co., Ltd.) and Ebara Milder (product name, manufactured by Ebara Corporation) and high-speed emulsifying dispersers such as T. K. Homomixer Mark II (product name, manufactured by PRIMIX Corporation) and Cavitron CD1000 (product name, manufactured by Pacific Machinery & Engineering Co., Ltd.)

The mixture of the colorant dispersion and the aqueous dispersion medium is appropriately passed through the high-speed stirring device, thereby being suspended and forming the colorant dispersion into droplets. The peripheral speed of the high-speed stirring device is generally from 10 m/s to 100 m/s, and preferably from 15 m/s to 60 m/s. The amount of the mixture passed through the high-speed stirring device is, in terms of residence time, generally from 0.5 second to 300 seconds, preferably from 1 second to 250 seconds, and more preferably from 2 seconds to 240 seconds.

(3) Step of Forming Colored Resin Particles

By the following step (3a) or (3b), colored resin particles are produced from the droplets of the colorant dispersion obtained through the above steps (1) and (2).

In the case of the colorant dispersion produced by the above (a), the droplets of the colorant dispersion thus obtained correspond to droplets of a polymerizable monomer composition; therefore, colored resin particles are produced by subjecting the aqueous dispersion containing the droplets to a polymerization step. When polymerized, the polymerizable monomer is formed into a binder resin in the colored resin particles. Meanwhile, in the case of the colorant dispersion prepared by the above (b), the aqueous dispersion containing the droplets of the colorant dispersion obtained by the droplets forming step, is subjected to a desolventizing step for removal of the organic solvent, thereby forming colored resin particles.

(3a) Polymerization Step

In the presence of the polymerization initiator, the aqueous dispersion containing the droplets of the colorant dispersion (the polymerizable monomer composition) obtained in the above-described droplets forming step, is heated to polymerize the polymerizable monomer in the droplets. The polymerization temperature is preferably 50° C. or more, and more preferably from 60° C. to 95° C. The polymerization reaction time is preferably from 1 hour to 20 hours, and more preferably from 2 hours to 15 hours.

To polymerize the droplets in a stably dispersed state, in the polymerization step, the polymerization reaction may be promoted while continuing a dispersion treatment for forming or stabilizing the droplets.

(3b) Desolventizing Step

Removal of the organic solvent from the aqueous dispersion containing the droplets of the colorant dispersion obtained in the above-described droplets forming step, can be carried out by gradually heating the aqueous dispersion while stirring. Also, the removal can be carried out by spraying the aqueous dispersion into a dry atmosphere while stirring, or by depressurizing the aqueous dispersion while stirring. These solvent removal operations can be appropriately combined. By the solvent removal operation(s), the organic solvent in the droplets is absolutely evaporated and removed.

The colored resin particles thus obtained may be used as they are as a polymerization toner, or they may be mixed with an external additive and used as a polymerization toner. It is preferable that the colored resin particles are so-called core-shell type (or "capsule type") colored resin particles obtained by using the colored resin particles as a core layer and forming a shell layer, which is a layer that is different from the core layer, around the core layer. By covering the core layer composed of a substance having a low softening point with a substance having a higher softening point, the core-shell type colored resin particles can achieve a balance between lowering of fixing temperature and prevention of aggregation during storage.

A method for producing the core-shell type colored resin particles is not particularly limited. The core-shell type colored resin particles can be produced by a conventional method. The in situ polymerization method and the phase separation method are preferred from the viewpoint of production efficiency.

Hereinafter, the method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to the aqueous dispersion in which the colored resin particles are dispersed, and then polymerizing the polymerizable monomer.

As the polymerizable monomer for shell, the above-mentioned polymerizable monomers can be used. Among the polymerizable monomers, those that can provide a resin having a Tg of more than 80° C. (e.g., styrene, acrylonitrile and methyl methacrylate) are preferably used alone or in combination of two or more kinds.

As the polymerization initiator used for polymerization of the polymerizable monomer for shell, examples include, but are not limited to, water-soluble polymerization initiators including persulfates such as potassium persulfate and ammonium persulfate, and azo type initiators such as 2,2'-azobis(2-methyl-N-(2-hydroxyethyl)propionamide) and 2,2'-azobis(2-methyl-N-(1,1-bis(hydroxymethyl)2-hydroxyethyl)propionamide). The amount of the polymerization initiator is preferably from 0.1 part by mass to 30 parts by mass, and more preferably from 1 part by mass to 20 parts by mass, with respect to 100 parts by mass of the polymerizable monomer for shell. The polymerization temperature of the shell layer is preferably 50° C. or more, and more preferably from 60° C. to 95° C. The polymerization reaction time is preferably from 1 hour to 20 hours, and more preferably from 2 hours to 15 hours.

(4) Washing Step

In general, the aqueous dispersion of the colored resin particles is washed by the washing step. The washing step includes an acid washing step and a subsequent water washing step, both of which will be described below. The water washing step can be repeated several times.

(4-1) Acid Washing Step

When an acid-soluble inorganic compound (e.g., an inorganic hydroxide) is used as the dispersion stabilizer in the aqueous dispersion of the colored resin particles, the dispersion stabilizer is dissolved in water and removed by adding acid to the aqueous dispersion of the colored resin particles. When the dispersion stabilizer is an alkali-soluble inorganic compound, alkali is used in place of the acid.

(4-2) Water Washing Step

In the water washing step, the aqueous dispersion obtained in the acid washing step is filtered and then washed with water by a washing device. As the washing device, various kinds of known washing devices can be used. It is preferable to use a belt filter, a rotary filter and a filter press alone or in combination of two or more kinds. It is more preferable to use a belt filter or a rotary filter.

(5) Dehydrating and Drying Steps

After the washing step, generally, the aqueous dispersion of the colored resin particles is dehydrated by the dehydrating step and then dried, thereby obtaining the colored resin particles in a dry state.

The dehydrating method is not particularly limited, and various kinds of known methods can be used. As the method, examples include, but are not limited to, centrifugal filtration, vacuum filtration and pressure filtration. Of them, centrifugal filtration is preferred. As a filtration dehydration device, examples include, but are not limited to, a peeler centrifuge and a siphon peeler centrifuge.

The drying method is not particularly limited, and various kinds of known methods can be used. As the method, examples include, but are not limited to, vacuum drying, flash drying and a spray drier.

(6) Colored Resin Particles

The colored resin particles obtained through the above steps will be described (the colored resin particles described below encompass both core-shell type colored resin particles and different types of colored resin particles).

For the colored resin particles constituting the toner of the present invention, the volume average particle diameter Dv is preferably from 5 μm to 10 μm and more preferably from 6 μm to 8 μm. When the Dv is in the range, the toner is excellent in flowability and transferability; blur and a decrease in image density do not occur; and high image resolution is obtained.

For the colored resin particles, the ratio Dv/Dn between the volume average particle diameter Dv and the number average particle diameter Dn, is preferably from 1.0 to 1.3, and more preferably from 1.0 to 1.2. When the ratio Dv/Dn is in the range, blur and a decrease in image density do not occur, and high image resolution is obtained. The volume average particle diameter and the number average particle diameter of the colored resin particles can be measured by Multisizer (product name, manufactured by Beckman Coulter, Inc.), etc.

(7) Toner

In the present invention, the colored resin particles thus obtained can be used as they are as a toner for electrophotographic development. To control the chargeability, flowability and storage stability of the toner, the colored resin particles can be mixed with an external additive and, as needed, other particles, using a high-speed stirring device such as Henschel Mixer (product name), thereby obtaining a one-component toner. Also, the colored resin particles, an external additive and, as needed, other particles can be mixed with carrier particles such as ferrite or iron powder, using a known method, thereby obtaining a two-component toner.

As the external additive, examples include, but are not limited to, inorganic particles that are generally used for the purpose of increasing flowability and chargeability, and organic resin particles that are generally used for the same purpose. As the inorganic particles, examples include, but are not limited to, silica, aluminum oxide, titanium oxide, zinc oxide, tin oxide, calcium carbonate, calcium phosphate and cerium oxide. As the organic resin particles, examples include, but are not limited to, a methacrylic acid ester polymer, an acrylic acid ester polymer and a styrene-methacrylic acid ester copolymer. As the external additive, silica and titanium oxide are preferred.

EXAMPLES

The toner production method of the present invention will be described in more detail by way of examples. The present invention is not limited to the following examples, and all designations of part(s) and % are expressed on mass basis, unless otherwise noted.

Example 1

<Dispersing Step>

A polymerizable monomer comprising the following monovinyl monomers and crosslinkable monomer, was put in a stirring tank 5 of a device shown in FIG. 1. Also, the following colorant and macromonomer were put in the same stirring tank. The stirring tank was equipped with stirring blades 7 that were connected to a stirring motor 6.

Monovinyl monomers: 80.5 Parts of styrene and 19.5 parts of n-butyl acrylate

Crosslinkable monomer: 0.5 Part of divinylbenzene

Colorant: 5 Parts of a copper phthalocyanine pigment (C.I. Pigment Blue 15:3)

Macromonomer: 0.25 part of a polymethacrylic acid ester macromonomer (product name: AA6, manufactured by: TOAGOSEI Co., Ltd.)

They were stirred and mixed to obtain a mixed solution. The mixed solution was supplied from the bottom of the stirring tank 5 to a disperser 1 by a circulation line 14, using a circulation pump 13, through a valve 11 and a circulation line 12. The mixed solution was supplied to the disperser 1 from a mixed solution inlet 3 of a casing 2, and the colorants were dispersed and mixed. Next, the mixed solution was subjected to wet pulverization and then returned from a mixed solution outlet 4 to the stirring tank 5, in which stirring was continued by the stirring blades 7, through a return line 15. Therefore, a preliminarily prepared mixed solution (a polymerizable monomer mixture) was obtained. At this time, to keep the temperature inside the stirring tank 5 at 30° C., a medium was circulated inside a jacket 8. As the disperser 1, a media type disperser (product name: Pico Grain Mill, manufactured by: Asada Iron Works Co., Ltd.) was used.

Next, as a release agent, 5 parts of an ester wax was added to the preliminarily prepared mixed solution obtained in the above step, while the mixed solution was stirred in the stirring tank 5. Then, from a hopper (not shown) disposed in the upper part of the stirring tank 5, which is used to store a charge control resin, 1 part of a charge control resin (styrene acrylic resin "FCA-207P" manufactured by Fujikura Kasei Co., Ltd.) was injected into the stirring tank 5, through a material switching valve 20, a fill pipe 16, an injection valve 17 and an injection pipe 18, all of which were heated by a pipe heating apparatus 21 at 50° C. The charge control resin was mixed with the preliminarily prepared mixed solution, thereby obtaining a colorant dispersion (a polymerizable monomer composition). The pipes were stainless-steel (SUS) pipes. At this time, the condensation temperature of the polymerizable monomer was about 15° C.

<Droplets Forming Step>

An aqueous solution obtained by dissolving 6.2 parts of sodium hydroxide (alkali metal hydroxide) in 50 parts of ion-exchanged water, was gradually added, with stirring, to an aqueous solution obtained by dissolving 10.2 parts of magnesium chloride (water-soluble polyvalent metal salt) in 250 parts of ion-exchanged water. Therefore, a magnesium hydroxide colloid (hardly water-soluble metal hydroxide colloid) dispersion (an aqueous dispersion medium) was obtained.

The magnesium hydroxide colloid dispersion thus prepared was put in a polymerization container equipped with a stirring device. The colorant dispersion obtained above was added thereto and, with stirring, 1.2 parts of t-dodecyl mercaptan and 5 parts of t-butylperoxy-2-ethylbutanoate (product name: Torigonox 27, manufactured by: Akzo Nobel, purity: 98%) were further added thereto as a molecular weight modifier and a polymerization initiator, respectively.

A mixed dispersion thus obtained was taken from the bottom of the polymerization container and passed through a high-speed stirring device (product name: Milder, manufactured by: Pacific Machinery & Engineering Co., Ltd.) at a rotational frequency of 15,000 rpm. The passed mixed dispersion was returned to the original polymerization container at an ejection speed of 0.5 m/s through a circulation pipe, and then circulated and suspended, thereby forming droplets of the colorant dispersion.

The aqueous dispersion containing the droplets of the colorant dispersion was heated to 90° C. to initiate a polymerization reaction of the polymerizable monomer in the droplets. After a polymerization conversion rate of almost 100% was reached, 1 part of methyl methacrylate as a polymerizable monomer for shell and 0.1 part of a water-soluble initiator (product name: VA086, manufactured by: Wako Pure Chemical Industries, Ltd.) dissolved in 10 parts of ion-exchanged water, were added in the polymerization container. After the polymerization was further continued for 4 hours, the reaction was stopped by water cooling. Therefore, an aqueous dispersion of colored resin particles was obtained.

The aqueous dispersion of the colored resin particles was washed with acid, dehydrated, washed with water, dehydrated and then dried, thereby obtaining the colored resin particles in a dry state. To 100 parts of the thus-obtained colored resin particles, 0.6 part of hydrophobized silica (product name: RX-100, manufactured by: Nippon Aerosil Co., Ltd.) was added and mixed using a Henschel Mixer (product name), thereby obtaining a toner.

A series of the above-mentioned operations (from the preparation of the preliminarily prepared mixed solution to the obtainment of the toner) were repeated 69 times. However, the injection pipe 18 was not clogged.

Comparative Example 1

A toner was obtained in the same manner as Example 1, except that the pipe heating apparatus 21 was not introduced.

When the above-mentioned series of the operations (from the preparation of the preliminarily prepared mixed solution to the obtainment of the toner) were repeated 4 times, the injection pipe 18 was clogged. As a result of observing the inside of the pipe, it was found that large amounts of scale attached to the inner wall of the pipe. Therefore, it was needed to detach and clean up the pipe.

The results of Example 1 and Comparative Example 1 are shown in Table 1. From the results shown in Table 1, it is clear that according to the present invention, even in the case of long-term continuous production, pipe clogging is suppressed, and a toner is stably and efficiently produced. The toner thus obtained contained less coarse particles and was excellent in image quality.

TABLE 1

| | Example 1 | Comparative Example 1 |
|---|---|---|
| Pipe heating apparatus | Yes | No |
| Pipe temperature | About 50° C. | About 0° C. to 40° C. |
| Number of repeated operations | 69 Times or more | 4 Times |

REFERENCE SIGNS LIST

1. Disperser
2. Casing
3. Mixed solution inlet
4. Mixed solution outlet
5. Stirring tank
6. Stirring motor
7. Stirring blades
8. Jacket
9. Temperature-regulating medium inlet
10. Temperature-regulating medium outlet
11. Valve
12. Circulation line
13. Circulation pump
14. Circulation line
15. Return line
16. Fill pipe
17. Injection valve
18. Injection pipe
19. Inert gas introduction valve
20. Material switching valve
21. Pipe heating apparatus

The invention claimed is:

1. A toner production method comprising:

a dispersing step for obtaining a colorant dispersion by, in a stirring tank, (a) dispersing or dissolving a colorant and a charge control agent in a polymerizable monomer, or (b) dispersing or dissolving a binder resin, a colorant and a charge control agent in an organic solvent, and a droplets forming step by suspending the colorant dispersion in an aqueous dispersion medium, wherein, in the dispersing step, the binder resin, colorant or charge control agent is added to the polymerizable monomer or organic solvent in the stirring tank, from a hopper disposed in an upper part of the stirring tank, through a pipe heated by a heating device, wherein, a heating temperature of the pipe is higher than a condensation temperature at which the polymerizable monomer or organic solvent is vaporized.

2. The toner production method according to claim 1, wherein, in the dispersing step, a release agent and/or a retention aid is further added to the polymerizable monomer or organic solvent in the stirring tank, from the hopper disposed in the upper part of the stirring tank, through the pipe heated by the heating device.

3. The toner production method according to claim 1, wherein the heating device is a self-temperature-regulating electric heater that is able to control power output depending on temperature change.

* * * * *